US006414289B1

(12) United States Patent
Lee et al.

(10) Patent No.: US 6,414,289 B1
(45) Date of Patent: Jul. 2, 2002

(54) WALL-MOUNTED MICROWAVE OVEN AND METHOD FOR CONTROLLING THE SAME

(75) Inventors: Sung-Ho Lee; Young-Won Cho, both of Suwon; Tae-Soo Kim, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/885,137

(22) Filed: Jun. 21, 2001

(30) Foreign Application Priority Data

Mar. 12, 2001 (KR) ..... 2001-12687

(51) Int. Cl.[7] ..... H05B 6/68

(52) U.S. Cl. ..... 219/757; 219/702; 219/718; 126/299 D

(58) Field of Search ..... 219/757, 702, 219/715, 716, 718, 681; 126/299 R, 299 D

(56) References Cited

U.S. PATENT DOCUMENTS 4,227,062 A * 10/1980 Payne et al. ..... 219/718
4,724,291 A * 2/1988 Inumada ..... 219/718
4,886,046 A 12/1989 Welch et al. ..... 126/299
6,025,582 A * 2/2000 Kang et al. ..... 219/757
6,072,169 A * 6/2000 Kang et al. ..... 219/702
6,093,922 A * 7/2000 Kim ..... 219/757
6,304,046 B1 * 10/2001 Lee et al. ..... 318/439

* cited by examiner

*Primary Examiner*—Philip H. Leung
(74) *Attorney, Agent, or Firm*—Robert E. Bushnell, Esq.

(57) ABSTRACT

A microwave oven includes a hood unit including a hood motor, a magnetron, a transformer having primary and secondary coils, the transformer generating a high voltage in a turn ratio of the primary and secondary coils and supplying the generated high voltage to the magnetron, a hood unit driver for controlling an operation of the hood unit, power output switching means for controlling the level of a voltage to be supplied to the transformer, and a controller for controlling the power output switching means to control the level of the voltage to be supplied to the transformer according to a given operation mode of the hood unit. The power output level of the microwave oven is automatically controlled according to a given operation mode of the hood motor such that the sum of the oven power output and the hood motor power output is constant.

9 Claims, 6 Drawing Sheets

WALL-MOUNTED MICROWAVE OVEN AND METHOD FOR CONTROLLING THE SAME

CLAIM OF PRIORITY

This application makes reference to, incorporates the same herein, and claims all benefits accruing under 35 U.S.C. §119 from an application for *A WALL MOUNT TYPE MICRO WAVE OVEN AND ITS CONTROL METHOD* earlier filed in the Korean Industrial Property Office on Mar. 12, 2001 and there duly assigned Serial No. 12687/2001 by that Office.

BACKGROUND OF THE INVENTION

1. Field of the Invention

The present invention relates in general to microwave ovens, and more particularly to a wall-mounted microwave oven and a method for controlling the same, wherein the power output of the microwave oven is controlled according to the operation of a hood motor such that the sum of the oven power output and the hood motor power output is constant, thereby preventing the oven from being overloaded.

2. Description of the Prior Art

Microwave ovens are generally adapted to perform a cooking operation based on a super-high frequency, in a different manner from cooking equipment of an external heating type based on thermal conduction and thermal radiation. Such a conventional microwave oven includes a super-high frequency oscillation tube, or a magnetron, for generating a super-high frequency of 2,470 MHz in response to high-voltage power applied thereto. The super-high frequency of 2,470 MHz generated from the magnetron causes an electric field to turn in direction at a rate of 2.45 billion times per second. Where this super-high frequency is applied to food, molecules of water in the food vibrate at a rate of 2.45 billion times per second while generating a large amount of heat, thereby cooking the food.

A conventional wall-mounted microwave oven employing the above-mentioned principle is operated simultaneously with a hood motor upon cooking food.

FIGS. 1*a* and 1*b* are graphs illustrating the operation of a conventional wall-mounted microwave oven.

As shown in FIGS. 1*a* and 1*b,* the conventional wall-mounted microwave oven is operated simultaneously with a hood motor upon cooking food. For this reason, even in the initial cooking state requiring a large amount of power consumption, the microwave oven and the hood motor are together operated, resulting in an increase in power consumption.

Accordingly, there has been a need for a technique capable of controlling the operation of a microwave oven according to the operation of a hood motor in a cooking mode. However, a conventional wall-mounted microwave oven cannot control its power output level according to the operation of a hood motor, so it cannot effectively solve a power consumption increase or overload.

SUMMARY OF THE INVENTION

Therefore, the present invention has been made in view of the above problem, and it is an object of the present invention to provide a wall-mounted microwave oven and a method for controlling the same, wherein the power output level of the microwave oven is automatically controlled according to the operation of a hood motor such that the sum of the oven power output and the hood motor power output is constant.

In accordance with one aspect of the present invention, the above and other objects can be accomplished by the provision of a wall-mounted microwave oven including a hood unit including a hood motor; a magnetron; a transformer having primary and secondary coils, the transformer generating a high voltage in a turn ratio of the primary and secondary coils and supplying the generated high voltage to the magnetron; a hood unit driver for controlling an operation of the hood unit; power output switching means for controlling the level of a voltage to be supplied to the transformer; and a controller for controlling the power output switching means to control the level of the voltage to be supplied to the transformer according to a given operation mode of the hood unit.

In accordance with another aspect of the present invention, there is provided a method for controlling a wall-mounted microwave oven, including the step of controlling a power output level of the microwave oven according to a given operation mode of a hood motor such that the sum of the oven power output and the hood motor power output is constant.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1A:
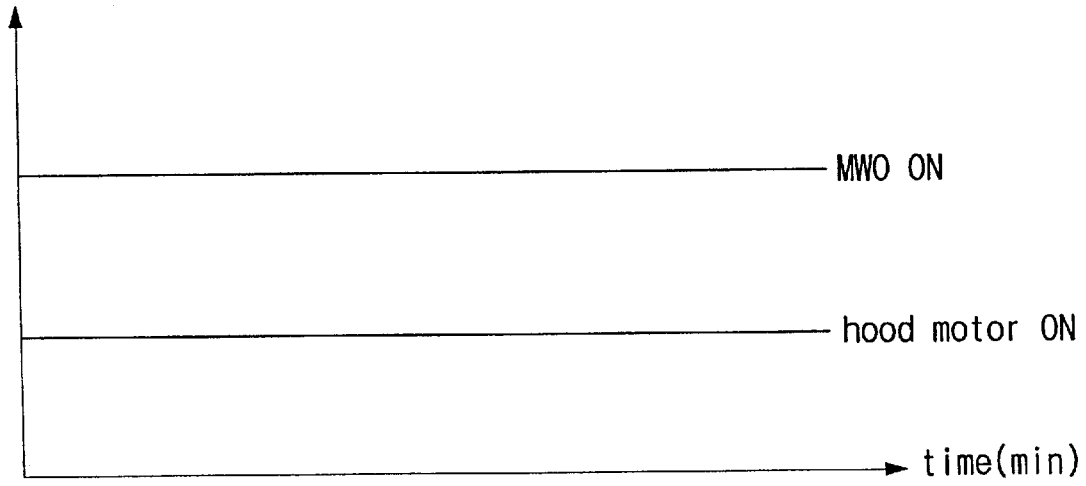
FIG. 1a Conventional Art
FIGS. 1*a* and 1*b* are graphs illustrating the operation of a conventional wall-mounted microwave oven.
Figure 1B:
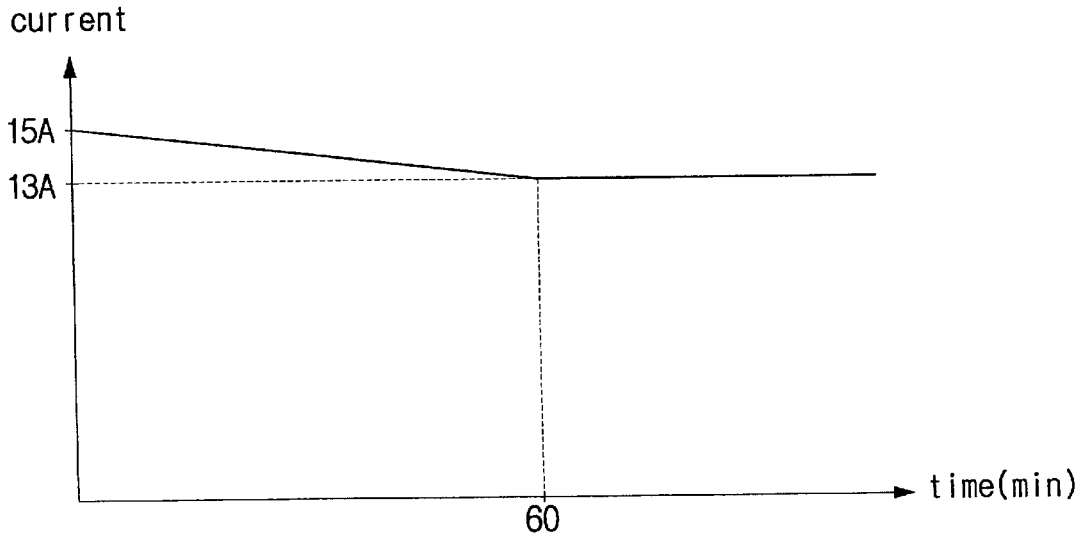
FIG. 1b Conventional Art
Figure 2:
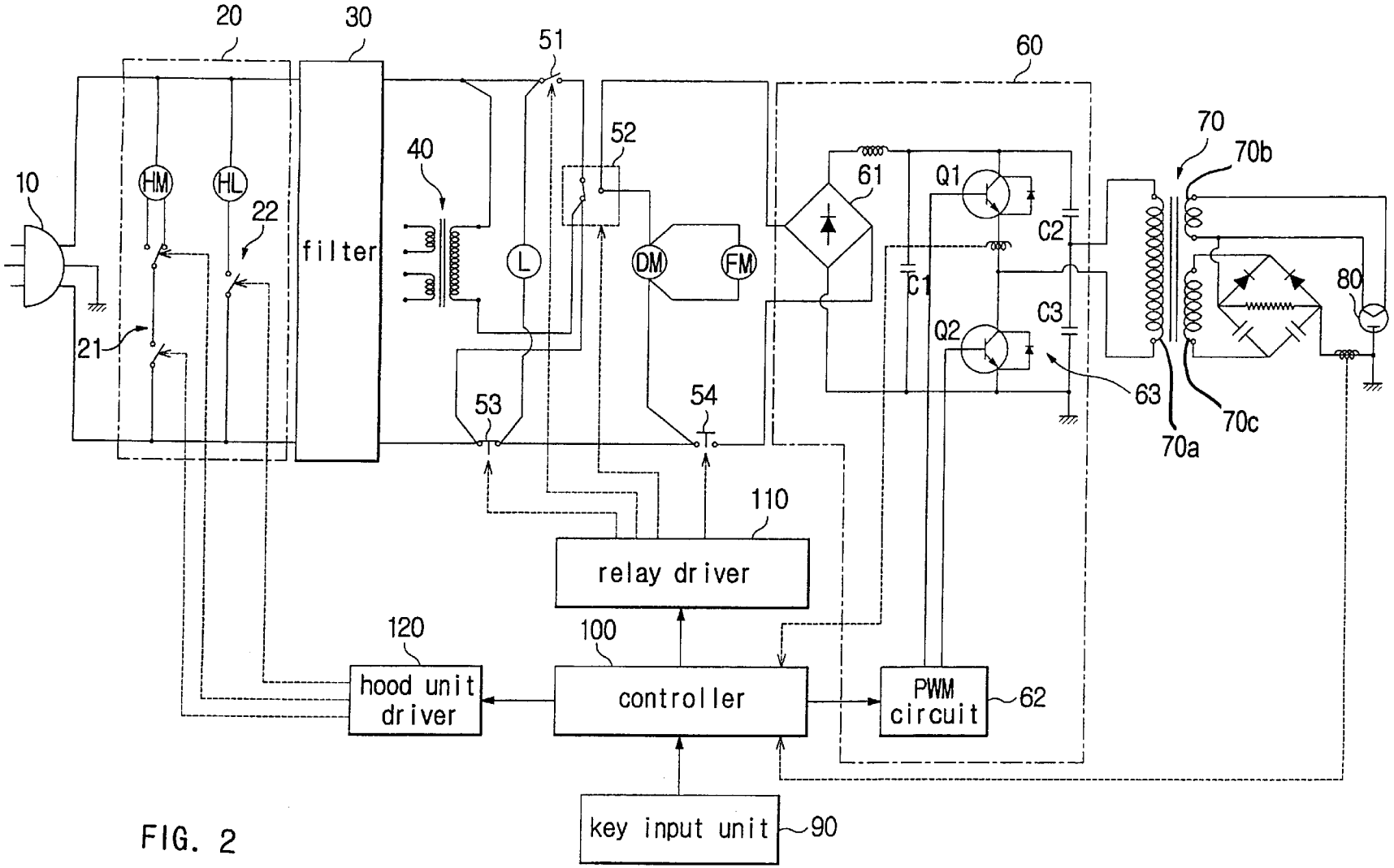
FIG. 2 is a circuit diagram showing the construction of a wall-mounted microwave oven in accordance with the present invention.

FIG. 2 is a circuit diagram showing the construction of a wall-mounted microwave oven in accordance with the present invention.

With reference to FIG. 2, the wall-mounted microwave oven of this invention includes a hood unit 20 including a hood motor HM, a hood motor relay 21 for switching the operation of the hood motor HM, a hood lamp HL, and a hood lamp relay 22 for switching the operation of the hood lamp HL.

The wall-mounted microwave oven further includes a controller 100 for controlling the entire operation of the oven, and a key input unit 90 connected electrically to the controller 100 for inputting an operation command from the user. The key input unit 90 inputs a variety of cooking commands and hood unit operation commands from the user and transfers them to the controller 100.

Connected to the output of the controller 100 are a hood unit driver 120 for driving the hood unit 20, a relay driver 110 for driving a variety of relays, which will be described later in detail, and a pulse width modulation (PWM) circuit 62 in power output switching means 60, which will be described later in detail.

The microwave oven further includes a filter 30 for removing noise from power from an electric cord 10, and a low-voltage transformer 40 for supplying a low voltage to the controller 100. The low-voltage transformer 40 is connected to the electric cord 10 via the filter 30 to receive a voltage from the cord 10, step it down and apply the resulting low voltage to the controller 100.

A primary safety switch 51 is connected to a power line extending from the filter 30 at its one terminal to block or pass the supply of power from the electric cord 10 according to the opening or shutting of a door of the microwave oven. A monitor switch 52 is connected to the other terminal of the primary safety switch 51 to, when the switch 51 becomes out of order, operate in an opposite manner to the switch 51 so as to form a short circuit. A secondary safety switch 53 is connected to the other terminal of the primary safety switch 51 via the monitor switch 52 at its one terminal and to the one terminal of the switch 51 via a lamp L of a cooking cavity at its other terminal. The lamp L is turned on/off in response to ON/OFF operations of the secondary safety switch 53.

A power relay 54 is connected to the other terminal of the secondary safety switch 53, and a drive motor DM and cooling fan motor FM are connected between the power relay 54 and the monitor switch 52. The drive motor DM is driven to turn a turntable. Power output switching means 60 is connected between the power relay 54 and a primary coil 70*a* of a high-voltage transformer 70, the high-voltage transformer also including secondary coils, 70*b* and 70*c*, as illustrated in FIG. 2, with the transformer 70 generating a high voltage in a corresponding turn ratio of the primary coil 70*a* and at least one secondary coil 70*b*, 70*c* to supply the generated high voltage to a magnetron 80. The power relay 54 acts to control the supply of power from the secondary safety switch 53 to the switching means 60.

The power output switching means 60 includes a rectifier 61 for rectifying commercial alternating current (AC) power, and a switching circuit 63 for switching a direct current (DC) voltage from the rectifier 61 to the primary coil 70*a* of the high-voltage transformer 70. To this end, the switching circuit 63 is provided with a plurality of switching devices. That is, the switching circuit 63 includes a first switching device Q1 and second switching device Q2 connected in series to the output of the rectifier 61. A first capacitor C1 is connected in parallel to the switching circuit 63. A second capacitor C2 and third capacitor C3 are connected in series to each other and in turn in parallel to the switching circuit 63.

A detailed description will hereinafter be given of a method for controlling the wall-mounted microwave oven with the above-stated construction in accordance with the present invention.

Figure 3A:
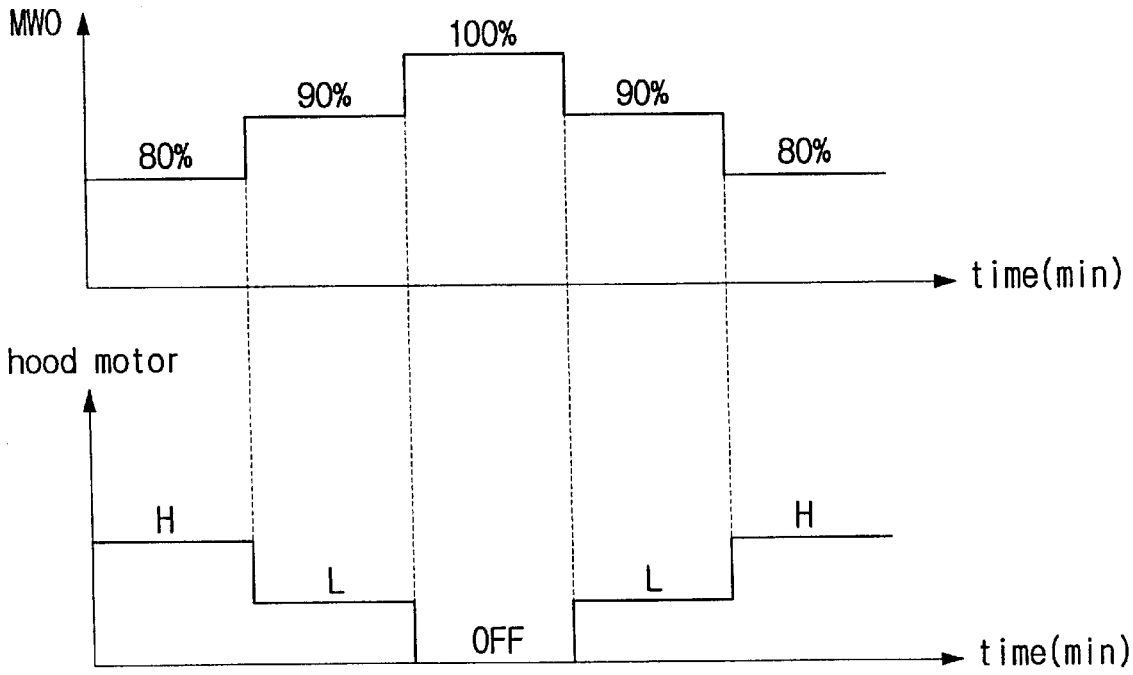
FIGS. 3*a* and 3*b* are graphs illustrating a method for controlling the wall-mounted microwave oven in accordance with the present invention.
Figure 3B:
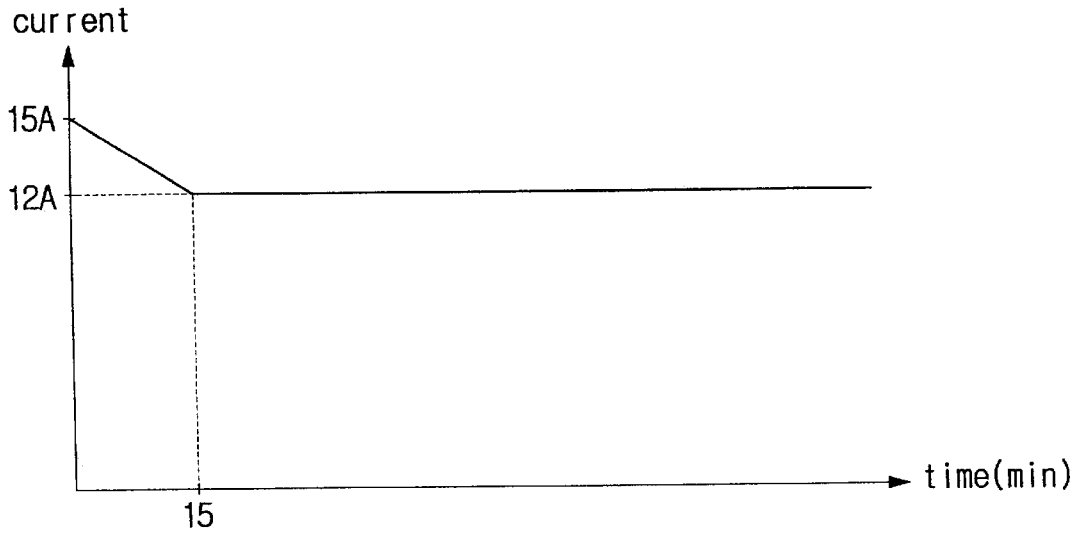

FIGS. 3*a* and 3*b* are graphs illustrating the operation of the wall-mounted microwave oven (MWO) in accordance with the present invention.

In the present embodiment, the power output of the microwave oven is controlled according to the operation of the hood unit 20, more particularly the hood motor HM. Namely, the power output level of the microwave oven is controlled according to a given operation mode of the hood motor HM such that the sum of the power output of the microwave oven and the power output of the hood motor is constant within the range of a predetermined allowable amount of power consumption.

In case the hood motor HM is operated at a high speed H, the controller 100 operates the microwave oven to output predetermined minimum power. To this end, the controller 100 controls the PWM circuit 62 in such a manner that a duty ratio of the first and second switching devices Q1 and Q2 has a predetermined minimum value, for example, about 80%.

Where the hood motor HM is operated at a low speed L, the controller 100 operates the microwave oven to output predetermined intermediate power. To this end, the controller 100 controls the PWM circuit 62 in such a manner that the duty ratio of the first and second switching devices Q1 and Q2 has a predetermined intermediate value, for example, about 90%, which is higher than the minimum duty ratio and lower than a maximum duty ratio as will hereinafter be described.

Provided that the hood motor HM is turned off, the controller 100 operates the microwave oven to output predetermined maximum power. To this end, the controller 100 controls the PWM circuit 62 in such a manner that the duty ratio of the first and second switching devices Q1 and Q2 has a predetermined maximum value, for example, 100%.

In the above manner, the power output level of the microwave oven is controlled according to a given operation mode of the hood motor HM such that the sum of the power output of the microwave oven and the power output of the hood motor is constant within the range of a predetermined allowable amount of power consumption. As a result, the microwave oven can be prevented from being overloaded while outputting the maximum power, which can be controlled as will hereinafter be described in detail.

Figure 4:
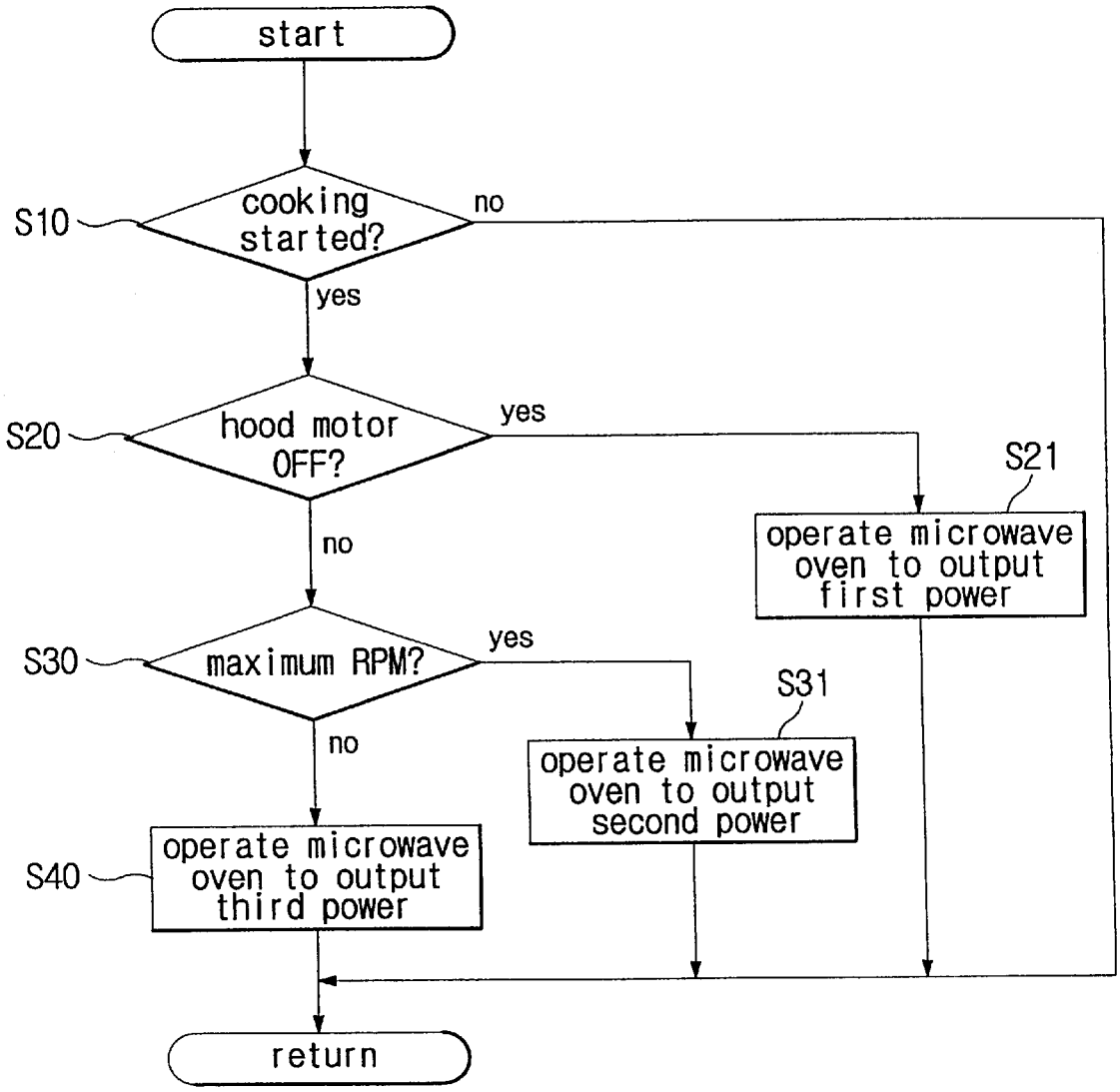
FIG. 4 is a flowchart illustrating the method for controlling the wall-mounted microwave oven in accordance with the present invention.

FIG. 4 is a flowchart illustrating the method for controlling the wall-mounted microwave oven in accordance with the present invention.

With reference to FIG. 4, first, the controller 100 determines whether a cooking start command has been inputted by the key input unit 90 (S10). Upon determining at step S10 that the cooking start command has been inputted by the key input unit 90, the controller 100 determines whether the hood motor HM of the hood unit 20 remains OFF (S20). At this time, the controller 100 determines whether the hood motor HM remains ON or OFF, from a determination about whether a hood motor ON command from the user has been inputted by the key input unit 90. Namely, provided that the hood motor ON command has not been inputted by the key input unit 90 and thus transferred to the hood unit driver 120, the controller 100 determines that the hood motor HM remains OFF.

In the case where it is determined at the above step S20 that the hood motor HM remains OFF, the controller 100 controls the PWM circuit 62 such that the microwave oven outputs first power, or predetermined maximum power (S21). That is, where the hood motor HM remains OFF, the controller 100 controls the PWM circuit 62 such that the duty ratio of the first and second switching devices Q1 and Q2 becomes 100%.

In the case where it is determined at the above step S20 that the hood motor HM does not remain OFF, the controller 100 determines whether the hood motor HM is driven at the maximum RPM (S30). At this time, provided that a hood motor maximum RPM operation command has been inputted by the key input unit 90 and then transferred to the hood unit driver 120, the controller 100 determines that the hood motor HM is driven at the maximum RPM.

If it is determined at the above step S30 that the hood motor HM is driven at the maximum revolutions per minute (RPM), then the controller 100 controls the PWM circuit 62 such that the microwave oven outputs second power, or predetermined minimum power (S31). That is, where the hood motor HM is driven at the maximum RPM, the controller 100 controls the PWM circuit 62 such that the duty ratio of the first and second switching devices Q1 and Q2 becomes about 80%.

Upon determining at the above step S30 that the hood motor HM is not driven at the maximum RPM, then the controller 100 recognizes that the hood motor HM is driven at the minimum RPM. As a result, the controller 100 controls the PWM circuit 62 such that the microwave oven outputs third predetermined power lower than the first power, or the maximum power, and higher than the second power, or the minimum power (S40). Namely, where the hood motor HM is driven at the minimum RPM, the controller 100 controls the PWM circuit 62 such that the duty ratio of the first and second switching devices Q1 and Q2 becomes about 90%.

In this manner, the power output of the microwave oven can be controlled according to a given operation mode of the hood motor. Therefore, the microwave oven can be prevented from being overloaded while outputting the maximum power within the range of the entire power consumption.

As apparent from the above description, the present invention provides a wall-mounted microwave oven and a method for controlling the same, wherein the power output level of the microwave oven is automatically controlled according to a given operation mode of a hood motor such that the sum of the oven power output and the hood motor power output is constant. Therefore, the microwave oven can be prevented from being overloaded while outputting the maximum power within the range of the entire power consumption.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wall-mounted microwave oven, comprising:

a hood unit including a hood motor;

a magnetron;

a transformer including a primary coil and at least one secondary coil, the transformer for generating a high voltage in a corresponding turn ratio of the primary coil and the at least one secondary coil and for supplying the high voltage generated to the magnetron;

a hood unit driver for controlling an operation of the hood unit;

a power output switching means for controlling a level of a voltage to be supplied to the transformer; and a controller for controlling the power output switching means to control the level of the voltage to be supplied to the transformer according to a given operation mode of the hood motor of the hood unit, whereby a sum of a power output of the microwave oven and a power output of the hood motor of the hood unit is constant during any given operation mode of the hood motor of the hood unit.

2. The microwave oven as set forth in claim 1, further comprised of the power output switching means including:

a rectifier for converting a commercial alternating current (AC) voltage supplied to the microwave oven into a direct current (DC) voltage;

a switching circuit for switching the direct current (DC) voltage from the rectifier to the primary coil of the transformer; and a pulse width modulation circuit for controlling a duty ratio of a switching control signal to the switching circuit under control of the controller.

3. A method for controlling a power output level of a wall-mounted microwave oven with a hood unit including a hood motor, the method comprising the step of:

controlling a power output level of the microwave oven according to a given operation mode of the hood motor of the hood unit such that a sum of a power output of the microwave oven and a power output of the hood motor of the hood unit is constant during any given operation mode of the hood motor of the hood unit.

4. The method as set forth in claim 3, further comprised of the step of controlling the power output level of the microwave oven including the steps of:

determining the given operation mode of the hood motor of the hood unit;

operating the microwave oven to output a predetermined maximum power, when it is determined at the step of determining the given operation mode of the hood motor of the hood unit that the given operation mode of the hood motor of the hood unit is an OFF mode;

operating the microwave oven to output a predetermined minimum power, when it is determined at the step of determining the given operation mode of the hood motor of the hood unit that the given operation mode of the hood motor of the hood unit is a maximum revolutions per minute (RPM) mode; and operating the microwave oven to output a predetermined intermediate power, when it is determined at the step of determining the given operation mode of the hood motor of the hood unit that the given operation mode of the hood motor of the hood unit is other than the OFF mode and other than the maximum revolutions per minute (RPM) mode, the predetermined intermediate power of the microwave oven being lower than the predetermined maximum power of the microwave oven and higher than the predetermined minimum power of the microwave oven.

5. A wall-mounted microwave oven, comprising:

a hood unit including a hood motor;

a magnetron;

a transformer including a primary coil and at least one secondary coil, the transformer for generating a high voltage in a corresponding turn ratio of the primary coil and the at least one secondary coil and for supplying the high voltage generated to the magnetron;

a hood unit driver for controlling an operation of the hood unit;

a power output switching means for controlling a level of a voltage to be supplied to the transformer; and a controller for controlling the power output switching means to control the level of the voltage to be supplied to the transformer according to a given operation mode of the hood motor of the hood unit, the level of the voltage to be supplied to the transformer corresponding to a predetermined maximum power of the microwave oven when the given operation mode of the hood motor of the hood unit is an OFF mode, the voltage to be supplied to the transformer corresponding to a predetermined minimum power of the microwave oven when the given operation mode of the hood motor of the hood unit is a maximum revolutions per minute (RPM) mode, and the level of the voltage to be supplied to the transformer corresponding to a predetermined intermediate power of the microwave oven when it is determined that the given operation mode of the hood motor of the hood unit is other than the OFF mode and other than the maximum revolutions per minute (RPM) mode, the predetermined intermediate power of the microwave oven being lower than the predetermined maximum power of the microwave oven and higher than the predetermined minimum power of the microwave oven.

6. The microwave oven as set forth in claim 5, further comprised of the power output switching means including:

a rectifier for converting a commercial alternating current (AC) voltage supplied to the microwave oven into a direct current (DC) voltage;

a switching circuit for switching the direct current (DC) voltage from the rectifier to the primary coil of the transformer; and a pulse width modulation circuit for controlling a duty ratio of a switching control signal to the switching circuit under control of the controller.

7. An apparatus for controlling a power output level of a wall-mounted microwave oven with a hood unit including a hood motor, comprising:

a power output switching means for controlling a power output level of the microwave oven; and a controller for controlling the power output switching means to control the power output level of the microwave oven according to a given operation mode of the hood motor of the hood unit, whereby a sum of a power output of the microwave oven and a power output of the hood motor of the hood unit is constant during any given operation mode of the hood motor of the hood unit.

8. The apparatus of the claim 7, further comprised of the power output level of the microwave oven corresponding to a predetermined maximum power of the microwave oven when the given mode of operation of the hood motor of the hood unit is an OFF mode, the power output level of the microwave oven corresponding to a predetermined minimum power of the microwave oven when the given operation mode of the hood motor of the hood unit is a maximum revolutions per minute (RPM) mode, and the power output level of the microwave oven corresponding to a predetermined intermediate power of the microwave oven when the given operation mode of the hood motor of the hood unit is other than the OFF mode and other than the maximum revolutions per minute (RPM) mode, the predetermined intermediate power of the microwave oven being lower than the predetermined maximum power of the microwave oven and higher than the predetermined minimum power of the microwave oven.

9. An apparatus for controlling a power output level of a wall-mounted microwave oven with a hood unit including a hood motor, comprising:

a power output switching means for controlling a power output level of the microwave oven;

a controller for controlling the power output switching means to control the power output level of the microwave oven according to a given operation mode of the hood motor of the hood unit, whereby the power output level of the microwave oven corresponds to a predetermined maximum power of the microwave oven when it is determined that the given operation mode of the hood motor of the hood unit is an OFF mode, the power output level of the microwave oven corresponds to a predetermined minimum power of the microwave oven when it is determined that the given operation mode of the hood motor of the hood unit is a maximum revolutions per minute (RPM) mode, and the power output level of the microwave oven corresponds to a predetermined intermediate power of the microwave oven when the given operation mode of the hood motor of the hood unit is other than the OFF mode and other than the maximum revolutions per minute (RPM) mode, the predetermined intermediate power of the microwave oven being lower than the predetermined maximum power of the microwave oven and higher than the predetermined minimum power of the microwave oven.

* * * * *